US007137776B2

(12) United States Patent
Draper et al.

(10) Patent No.: US 7,137,776 B2
(45) Date of Patent: Nov. 21, 2006

(54) FILM COOLING FOR MICROCIRCUITS

(75) Inventors: Samuel David Draper, Wallingford, CT (US); Michael Blair, Vernon, CT (US); Abbas Alahyari, Ellington, CT (US)

(73) Assignee: United Technologies Corporation, Hartford, CT (US)

( * ) Notice: Subject to any disclaimer, the term of this patent is extended or adjusted under 35 U.S.C. 154(b) by 445 days.

(21) Appl. No.: 10/176,458

(22) Filed: Jun. 19, 2002

(65) Prior Publication Data

US 2006/0210390 A1 Sep. 21, 2006

(51) Int. Cl.
*F01D 5/18* (2006.01)

(52) U.S. Cl. ..... 415/115; 416/97 R

(58) Field of Classification Search ..... 415/115; 416/97 R, 96 R, 90 R, 95, 231 R, 231 B, 416/223 A; 60/752, 754
See application file for complete search history.

(56) References Cited

U.S. PATENT DOCUMENTS 3,672,787 A 6/1972 Thorstenson
3,957,104 A * 5/1976 Terpay ..... 416/96 A
4,664,597 A * 5/1987 Auxier et al. ..... 416/97 R
5,152,667 A 10/1992 Turner et al.
5,216,886 A * 6/1993 Ewing ..... 60/752
5,383,766 A 1/1995 Przirembel et al.
5,649,806 A 7/1997 Scricca et al.
6,213,714 B1 4/2001 Rhodes
6,247,896 B1 * 6/2001 Auxier et al. ..... 416/97 R
6,254,334 B1 * 7/2001 LaFleur ..... 416/97 R
6,280,140 B1 * 8/2001 Soechting et al. ..... 416/97 R
6,379,118 B1 4/2002 Lutum et al.
6,402,470 B1 * 6/2002 Kvasnak et al. ..... 416/97 R

FOREIGN PATENT DOCUMENTS

FR 2294330 7/1976

* cited by examiner

*Primary Examiner*—Edward K. Look
*Assistant Examiner*—Richard A. Edgar
(74) *Attorney, Agent, or Firm*—Bachman & LaPointe, P.C.

(57) ABSTRACT

An embedded microcircuit for producing an improved cooling film over a surface of a part, comprising an inlet through which a coolant gas may enter, a circuit channel extending from the inlet through which the coolant gas may flow, and a slot film hole formed at a terminus of the circuit channel through which the coolant gas may exit a part.

16 Claims, 4 Drawing Sheets

FILM COOLING FOR MICROCIRCUITS

BACKGROUND OF THE INVENTION

1. Field of the Invention

The present invention relates to a microcircuit cooling passage fabricated in a part and terminating in a slot film hole providing increased film coverage created by the rapid expansion and expulsion of a coolant gas through the slot film hole and across the surface of the part. More specifically, this invention relates to a method of incorporating microcircuits comprising slot film holes into parts requiring cooling so as form a protective film of cool air across the surface of the part as well as facilitate the convective transfer of heat from within the part.

2. Description of Related Art

Film cooling of airfoils depends on the gas-path momentum of a gas traveling across the surface of the airfoil to interact with the film air momentum and force the film air over the surface of the airfoil. If the momentum of the film air is too high, the film air will penetrate into the gas path air and not adhere to the surface. This phenomenon is called blow-off and is detrimental to film cooling.

Film holes and slots through which film air may exit are discrete features on the airfoil surface. A row of holes is often defined perpendicular to the gas path flow direction. This row of holes ejects a film cooling the area down-stream of the holes. Between holes in a row, there is no film from that row. This area depends on the conduction within the metal to cool the surface and therefore the metal sees something slightly higher than the average of the film temperature and the gas temperature. By increasing the size of the exits of the film holes, the coverage of the holes can be increased. This can be done by using more holes, and more cooling flow, or by diffusion the air exiting the hole so that the same amount of flow requires more area, and that area can be extended perpendicular to the gas path flow direction, increasing the coverage of the film row. This will increase the percentage of the airfoil surface covered by film, decreasing the average film temperature, and reducing the amount of surface relying on conduction for cooling.

With reference to FIGS. 1*a* and 1*b*, there is illustrated a cooling channel known to the art. Coolant gas 27 is circulated through the interior of a part and exits as exit gas 28 through a hole 22 permeating the part surface 12. Gas flow 24 is pulled across part surface 12 and is illustrated herein as moving from left to right across part surface 12. Gas flow 24 is usually generated as the result of the part moving, often in a rotary fashion, through a gas. Exit gas 28 exits the hole 22 in a direction that is substantially normal to part surface 12. As exit gas 28 exits the hole 22, it reacts to gas flow 24 and proceeds to move generally in the direction corresponding to the direction in which gas flow 24 is moving. As a result, exit gas 28 is pulled across the part surface 12 and tends to hug closely thereto forming a film 26.

It is therefore advantageous to configure the placement of holes 22 through a part surface 12 such that the resulting film 26, consisting of cool air, forms a protective coating over the part. One configuration known to the art is illustrated in FIG. 1*c*. A plurality of holes 22 are arranged along an axis 20 wherein axis 20 extends generally perpendicular to the direction of gas flow 24. Each hole has a width equal to break out height 16. Pitch 18 is computed as the distance along axis 20 required for a single repetition of a hole 22. Therefore the linear coverage afforded by such a pattern of holes is equal to break out height 16 divided by pitch 18. As defined, coverage increases if the holes are spaced closer together (the pitch decreases) or, maintaining a constant pitch, the width of the holes 22 is increased (the break out height 16 is increased). It is therefore preferable to configure holes 22 in a pattern in such a way that the coverage is maximized. Such a configuration provides for the greatest coverage by film 26 of part surface 12.

Unfortunately, as mentioned, it is common in the art for exit gas 28 to exit hole 22 in a direction normal to part surface 12. If the velocity of exit gas 28 is too great, exit gas 28 tends to extend for a distance above part surface 12 before reacting with gas flow 24. In such an instance, it is possible that gas flow 28 will fail to form a film 26 hugging the part surface 12. As noted, this phenomenon is referred to as "blow-off". Blow-off results in a failure of exit gas 28 to effectively form a protecting cooling film 26. It is, in theory, possible to construct holes 22 with apertures that increase in diameter as they approach part surface 12. Such an increase in aperture would serve to reduce the velocity of the exit gas 28 and increase the formation of film 26. However, the degree to which the aperture may be increased is constrained by the physics of fluid dynamics to a relatively small value. Slowing the velocity of exit gas 28 by decreasing the rate of flow by which cooling gas is pumped through the part merely decreases the amount of cool gas available to spread over part surface 12. It is common practice to configure the circuit channels through which cooling gas is pumped so that the flow of cooling gas remains attached and slowly diffuses through the channels and over the part's surface.

A conventional row of holes 22 arranged along an axis 20 typically results in coverages averaging 50%. With reference to FIG. 6*a*, there is illustrated a graphic depiction of the temperature gradient arising in a film resulting from the exit of cool gas through a hole. Regions 61'–61''' represent regions of increasing temperature present in a film formed on a part surface and extending away from a hole in the direction of gas flow 24. Note that the width of the regions 61'–61''' is not significantly wider than the hole through which the gas exits. Therefore, the conventional configuration of holes creates a film of cool air with a coverage of approximately 50%.

There therefore exists a need for the design of cooling channels, through which may move a cooling gas, capable of absorbing the heat generated in a moving part, such as a turbine, which provides for an exit velocity of the gas low enough to ensure the formation of protective film of cool air over the surface of the part. There is further needed a configuration of the exit points of such cooling channels that provides a coverage greater than the 50% coverage achieved by conventional means.

SUMMARY OF THE INVENTION

Accordingly, it is an object of the present invention to provide an improved cooling film over the surface of a part by embedding microcircuits under the surface of the part.

It is a further object of the present invention to provide a method whereby turbine parts may be fabricated incorporating the microcircuits of the present invention.

In accordance with the present invention, an embedded microcircuit for producing an improved cooling film over a surface of a part, comprises an inlet through which a coolant gas may enter, a circuit channel extending from the inlet through which the coolant gas may flow, and a slot film hole extending from the circuit channel to the surface of the part the film hole comprising, an opening through which the coolant gas enters from the circuit channel, and a slot hole through which the coolant gas exits the part.

In accordance with the present invention, a method of fabricating a part with improved cooling flow, comprises the steps of fabricating a plurality of microcircuits under a surface of the part, the microcircuits comprising an inlet through which a coolant gas may enter, a circuit channel extending from the inlet through which the coolant gas may flow, a slot film hole formed at a terminus of the circuit channel through which the coolant gas may exit a part, and providing a coolant gas to flow into the inlet, through the circuit channel, and out of the slot film hole.

BRIEF DESCRIPTION OF THE DRAWINGS

FIG. 1(*b*) A perspective illustration of a cooling hole known in the art.

FIG. 1(*c*) A perspective illustration of a plurality of cooling holes known in the art.

FIG. 2(*b*) A perspective illustration of a microcircuit for cooling.

FIG. 6(*b*) An illustration of the temperature gradient of a film produced by a slot film hole of the present invention.

DETAILED DESCRIPTION OF THE PREFERRED EMBODIMENT(S)

Microcircuits offer easy to manufacture, tailorable, high convective efficiency cooling. Along with high convective efficiency, high film effectiveness is required for an advanced cooling configuration. With reference to FIG. 2, there is illustrated a microcircuit 5. Microcircuits 5 may be machined or otherwise molded within a part. In a preferred embodiment, the microcircuits are formed of refractory metals forms and encapsulated in the part mold prior to casting. Several refractory metals including molybdenum (Mo) and Tungsten (W) have melting points that are in excess of typical casting temperatures of nickel based superalloys. These refractory metals can be produced in wrought thin sheet or forms in sizes necessary to make cooling channels characteristic of those found in turbine and combustor cooling designs. Specifically, such microcircuits may be fabricated into parts including, but not limited to, combustor liners, turbine vanes, turbine blades, turbine BOAS, vane endwalls, and airfoil edges. Preferably, such parts are formed in part or in whole of nickel based alloys or cobalt based alloys. Thin refractory metal sheets and foils possess enough ductility to allow bending and forming into complex shapes. The ductility yields a robust design capable of surviving a waxing/shelling cycle.

After casting, the refractory metal can be removed, such as through chemical removal, thermal leeching, or oxidation methods, leaving behind a cavity forming the microcircuit 5.

Figure 1C:
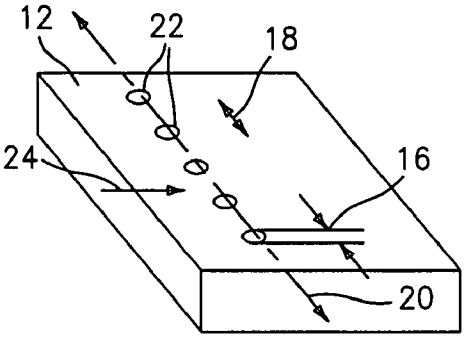
FIG. 1c prior art
FIG. 1(*a*) A cross-section diagram of a cooling hole known in the art.
Figure 2B:
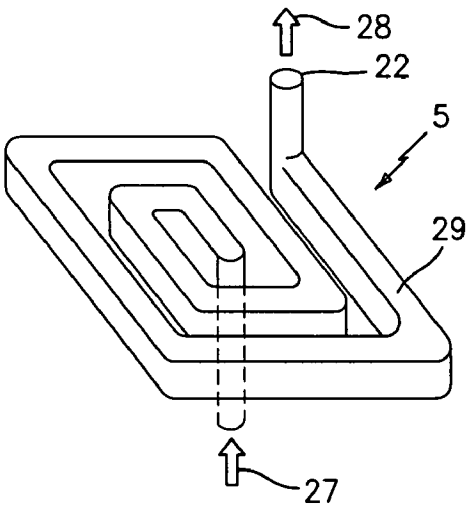
FIG. 2b prior art
FIG. 2(*a*) A cross-section diagram of a microcircuit for cooling.
Figure 1B:
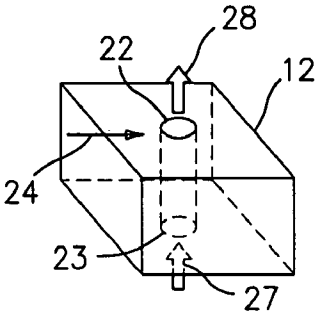
FIG. 1b prior art
Figure 2A:
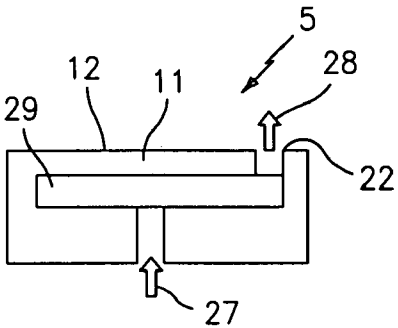
FIG. 2a prior art
Figure 1A:
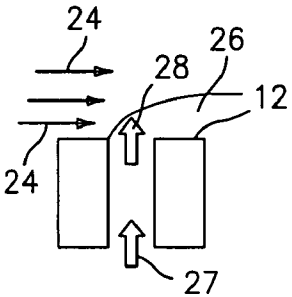
FIG. 1a prior art

FIG. 2*a* shows a cross section of one such microcircuit 5. Coolant gas 27 enters through an inlet into the microcircuit 5, proceeds through circuit channel 29 and exits through a hole 22 as exit gas 28. Circuit channel 29 is located beneath part surface 12 at a distance approximately equal to the diameter of circuit channel 29 and hole 22. With reference to FIG. 2*b*, there is illustrated a perspective view of microcircuit 5. In a preferred embodiment, circuit channel 29 assumes a predominantly spiral pattern. While illustrated with reference to a spiral pattern, the microcircuits of the present invention are not so limited. Rather the present invention is drawn widely to encompass any and all patterns in which a circuit channel 29 may be formed such that a suitable amount of heat transfer is accomplished from the part to the coolant gas.

In one embodiment a single hole 22 extends from circuit channel 29 through which exit gas 28 may exit. The relatively small size of the hole, with a radius approximating the width of the circuit channel 19, is used to control the amount of gas flow in the microcircuit 5. In addition, the orientation of the hole 22 forces the direction in which exit gas 28 exits hole 22 to be approximately normal to part surface 12.

Figure 3:
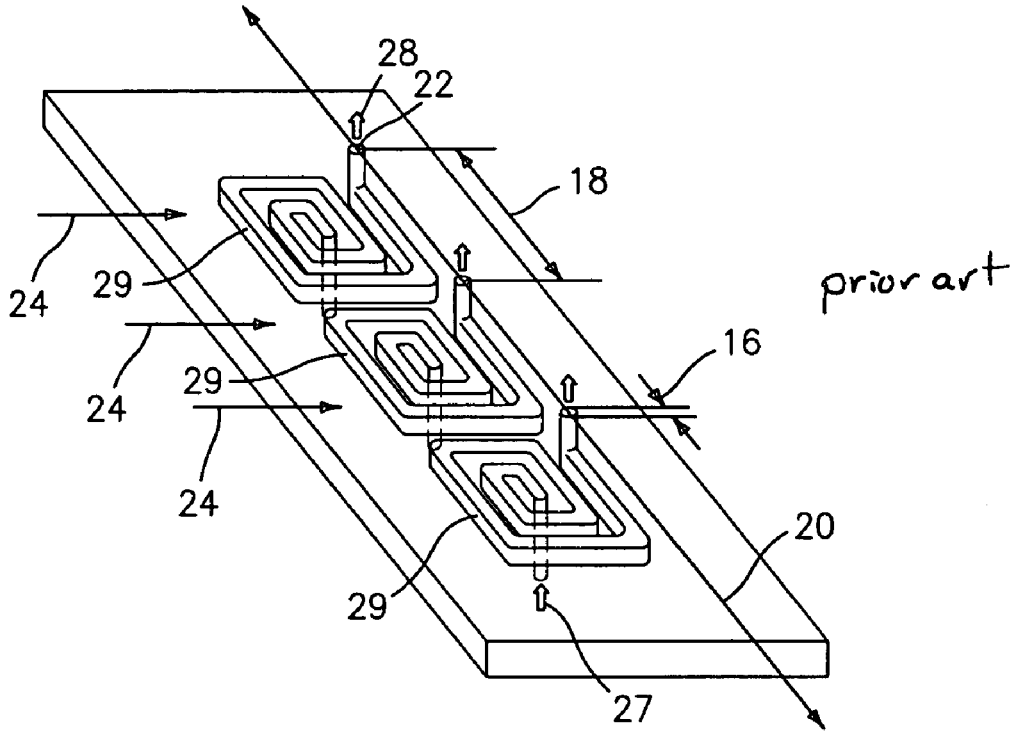
FIG. 3 A perspective illustration of a plurality of microcircuits used for cooling.

With reference to FIG. 3, there is illustrated a plurality of microcircuits 5 configured in a row along axis 20. Note that the expanse across each microcircuit 5 is considerably wider than the radius of each hole 22. As a result, the break out height 16 is relatively small when compared to pitch 18. Such a design typically results in a coverage (Break out height/Pitch) of approximately 10%. Such a coverage value limits the film effectiveness by providing a relatively small coverage.

Figure 4:
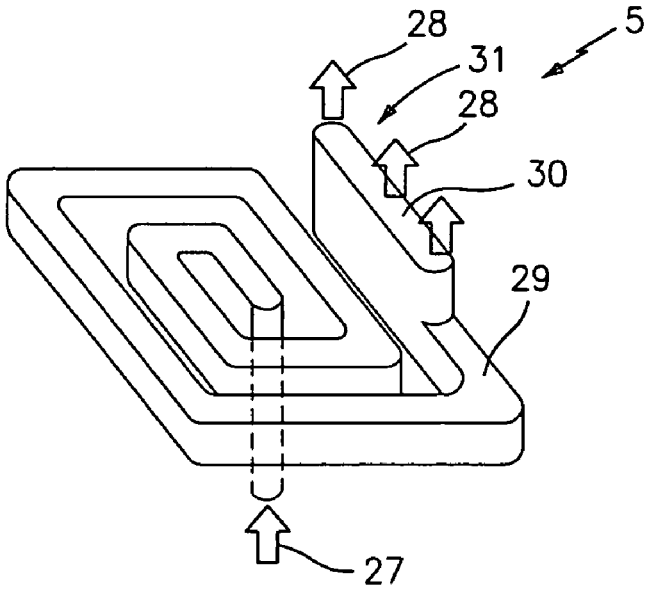
FIG. 4 A perspective illustration of a preferred embodiment of a microcircuit of the present invention.

With reference to FIG. 4 there is illustrated a preferred embodiment of a microcircuit 5 of the present invention. Microcircuit 5 is formed to provide a slot film hole 31 at the terminus of circuit channel 29 through which exit gas 28 may exit the microcircuit 5. As illustrated, slot film hole 31 extends for a generally linear expanse comprising slot hole 30. While so illustrated, the present invention is drawn broadly to encompass any slot hole 30 of a length greater than its width, the width of the circuit channel 29, regardless of its shape.

Because circuit channel 29 has a smaller cross sectional area than does slot hole 30, as exit gas 28 flows from circuit channel 29 through slot hole 30, it is diffused. By diffusing exit gas 28 along slot hole 30 which extends perpendicular to the gas flow 24 direction, the coverage of the cooling film 26 is increased. This increases the percentage of the airfoil surface covered by film, decreasing the average film temperature, and reducing the amount of surface relying on conduction for cooling.

Figure 5:
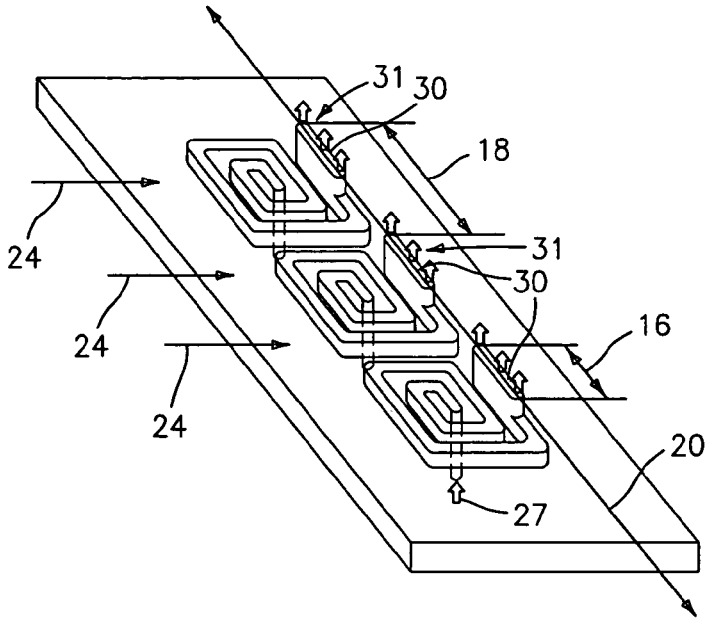
FIG. 5 prior art
FIG. 5 A perspective illustration of a plurality of microcircuits of the present invention.

With reference to FIG. 5, there is illustrated a plurality of microcircuits 5 configured in a row along axis 20. Break out point 16 is equal to the length of the expanse covered by slot film hole 30. In such a configuration, it is possible to obtain coverages of greater than 60%.

Figure 6A:
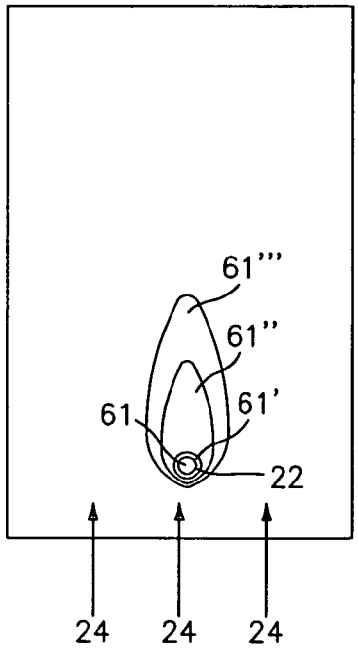
FIG. 6(*a*) An illustration of the temperature gradient of a film produced by a hole known in the art.
Figure 6B:
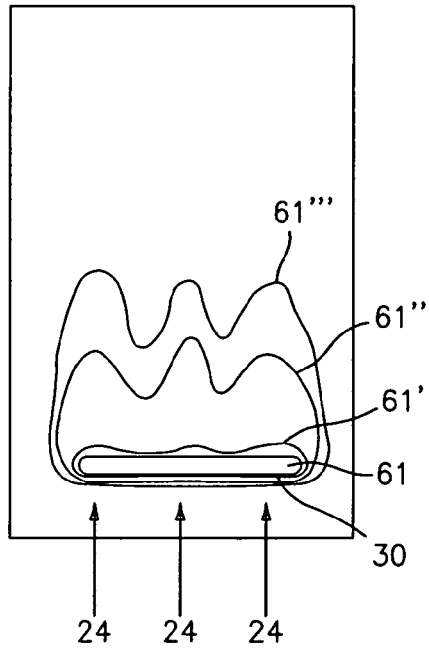

With reference to FIG. 6*b*, there is illustrated a graphic depiction of the temperature gradient arising in a film resulting from the exit of cool gas through a slot film hole of the present invention. Regions 61'–61''' represent regions of increasing temperature present in a film formed on a part surface and extending away from a hole in the direction of gas flow 24. Note that the width of the regions 61'–61''' is slightly wider than the slot hole 30 through which the gas exits. Therefore, a configuration of slot film holes 31 creates a film of cool air with a coverage of greater than 60%. With continued reference to FIG. 4, it is apparent that as the coolant gas proceeds through the circuit channel 29 prior to exiting as exit gas 28, it enters into slot film hole 30. As slot film hole 30 is larger in area than the average cross section of circuit channel 29, exit gas 28 exits slot film hole 30 at a lesser speed than that with which it travels through circuit channel 29. As a result, exit gas 28, while exiting normal to the part surface, does so at a reduced velocity so as to avoid unwanted blow-off. The result of using a microcircuit 5 with a slot film hole 30 through which exit gas 28 proceeds is the formation of protective film of cool air hugging a part's surface and providing a coverage of the surface in excess of 60%.

As noted above, convection and film are two effects used to cool turbine airfoils. Convection is cool air on the inside of the airfoil which extracts heat from the hot airfoil wall, heating the cooling air. The benefit of convection is reduced as the cooling air heats up. Film cooling involves ejecting the cool air after it has cooled the interior of the airfoil onto the surface to reduce the gas flow temperature. Once the film is ejected from the film holes, it begins to mix with the gas flow. This mixing reduces the film effectiveness, increasing the film temperature.

Figure 7:
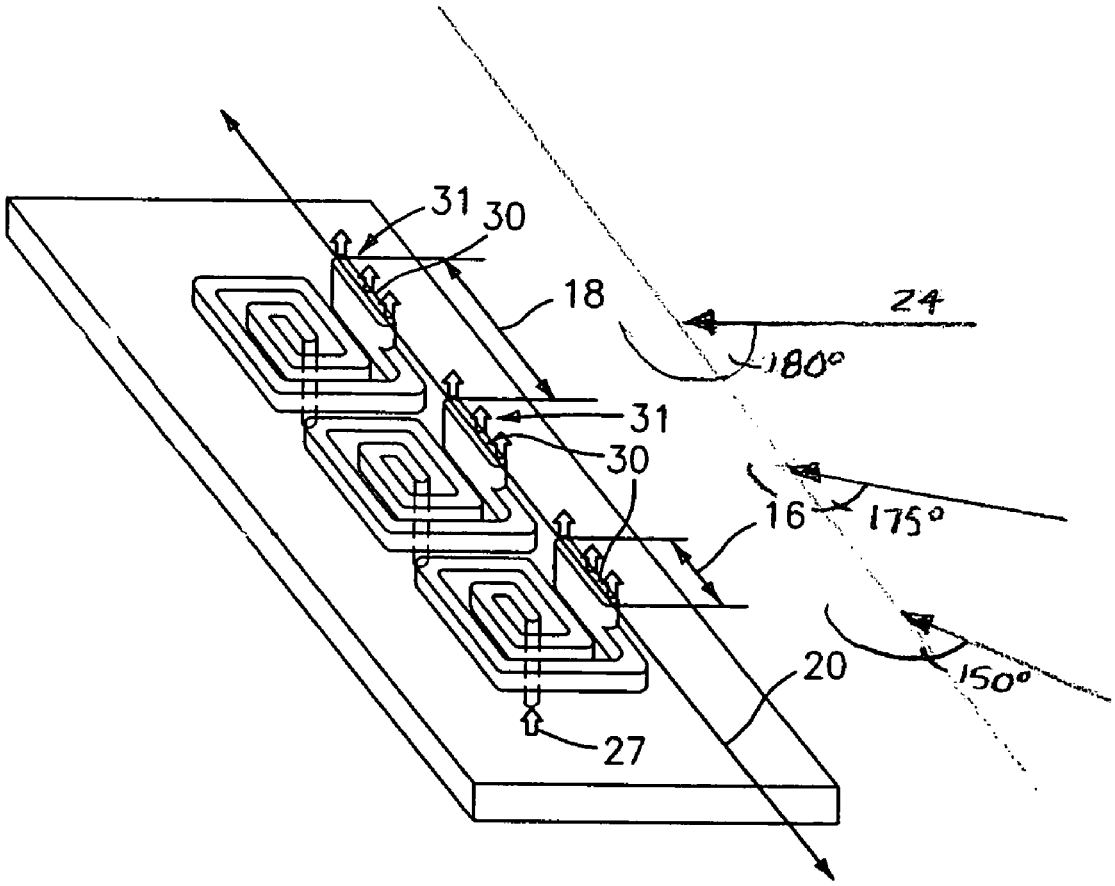
FIG. 7 A perspective illustration of a plurality of microcircuits of the present invention showing a range of gas flow directions.

In order to counteract the decrease in film effectiveness with distance down-stream of the film hole, a counter-flow heat exchanger could be used with the internal convective cooling of the cooling scheme. That is, the cooling air could be coldest far down-stream of the film hole, and due to internal convection, heat up as it travels forward toward the film cooling hole. This counter-flow effect evens-out the surface metal temperature. In such a configuration, gas flow direction 24 is generally in a direction 180 degrees out of alignment with, or opposite to, the flow direction of the cooling gas flow prior to being expelled from a part through which it flows as shown with reference to FIG. 7. Preferably, gas flow direction 24 is in a direction not less than ±150 degrees out of alignment with the flow direction of the cooling gas flow. Most preferably, the alignment differs not more than ±175 degrees.

As has been explained, the film cooling mechanism of the present invention causes a cooling film to be exposed to a region of sudden expansion prior to exiting a part thus causing rapid expansion of the cooling gas forming the film. By departing from the conventional practice of allowing steady and slow diffusion of a cooling gas as it flows through a part, the present invention achieves advantageous film cooling characteristics including wide coverage, lower gas temperatures, and reduced blow-off.

It is apparent that there has been provided in accordance with the present invention a microcircuit for improving film cooling of a part and a method of incorporating such microcircuits into parts which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. An embedded microcircuit for producing an improved cooling film over a surface of a part, comprising:

an inlet through which a coolant gas may enter;

a circuit channel extending from said inlet through which said coolant gas may flow, wherein said circuit channel extends from said inlet in a spiral pattern; and a slot film hole extending from said circuit channel to the surface of said part said film hole comprising:

an opening through which said coolant gas enters from said circuit channel; and a slot hole through which said coolant gas exits said part.

2. The microcircuit of claim 1 wherein said part is of a type selected from group consisting of combustor liners, turbine vanes, turbine blades, turbine BOAS, vane endwalls, and airfoil edges.

3. The microcircuit of claim 1 wherein said part is fabricated from a metal selected from the group consisting of nickel based alloys and cobalt based alloys.

4. The microcircuit of claim 1, wherein said slot film hole extends over a linear expanse.

5. The microcircuit of claim 4, wherein said linear expanse is between two and ten times the width of said circuit channel.

6. The microcircuit of claim 4, wherein said linear expanse is between three and six times the width of said circuit channel.

7. A method of fabricating a part with improved cooling flow, comprising the steps of:

fabricating a plurality of microcircuits under a surface of the part, said microcircuits comprising:

an inlet through which a coolant gas may enter;

a circuit channel extending from said inlet through which said coolant gas may flow, wherein said circuit channel extends from said inlet in a spiral pattern;

a slot film hole extending from said circuit channel to the surface of said part said film hole comprising:

an opening through which said coolant gas enters from said circuit channel; and a slot hole through which said coolant gas exits said part; and providing a coolant gas to flow into said inlet, through said circuit channel in a coolant gas flow direction, and out of said slot film hole.

8. The method of claim 7, wherein said fabricating said plurality of microcircuits comprises the steps of:

fashioning a refractory metal into the form of said plurality of said microcircuits;

inserting said refractory metal into a mold for casting said part; and removing said refractory metal from said part after casting.

9. The method of claim 8, wherein said plurality of microcircuits are arranged in one or more rows such that the slot film hole associated with each of said plurality of microcircuits forming a row reside generally upon an axis.

10. The method of claim 9, wherein said axis is oriented approximately perpendicular to the direction of a gas flow, said gas flow flowing across the surface of said part.

11. The method of claim 9, wherein the direction of the gas flow is 180 degrees out of alignment with that of said coolant gas flow direction.

12. The method of claim 9, wherein the direction of the gas flow is ±175 degrees out of alignment with that of said coolant gas flow direction.

13. The method of claim 9, wherein direction of gas flow is not less than ±150 degrees out of alignment with that of said coolant gas flow direction.

14. The method of claim 8, wherein said plurality of microcircuits are fabricated under said surface at a distance approximately equal to a width of said circuit channel.

15. The method of claim 7 wherein said part is of a type selected from group consisting of combustor liners, turbine vanes, turbine blades, turbine BOAS, vane endwalls, and airfoil edges.

16. The method of claim 7 wherein said part is fabricated from a metal selected from the group consisting of nickel based alloys and cobalt based alloys.

* * * * *